US008766742B2

(12) United States Patent
Torsiello et al.

(10) Patent No.: US 8,766,742 B2
(45) Date of Patent: Jul. 1, 2014

(54) INTEGRATED HYBRID-DIRECT COUPLERS

(75) Inventors: Rob Torsiello, Stuart, FL (US); Mark Bailly, West Melbourne, FL (US); Paul Davidsson, Jensen Beach, FL (US)

(73) Assignee: Smiths Interconnect Microwave Components, Inc., Stuart, FL (US)

( * ) Notice: Subject to any disclaimer, the term of this patent is extended or adjusted under 35 U.S.C. 154(b) by 326 days.

(21) Appl. No.: 13/428,953

(22) Filed: Mar. 23, 2012

(65) Prior Publication Data

US 2012/0242423 A1 Sep. 27, 2012

Related U.S. Application Data

(60) Provisional application No. 61/466,891, filed on Mar. 23, 2011.

(51) Int. Cl.
*H01P 5/18* (2006.01)
*H01P 3/08* (2006.01)

(52) U.S. Cl.
USPC ..... 333/116; 333/109

(58) Field of Classification Search
USPC ..... 333/109, 110, 112, 116, 117, 238
See application file for complete search history.

(56) References Cited

U.S. PATENT DOCUMENTS

| | | | | |
|---|---|---|---|---|
| 462,188 | A | 10/1891 | Allen | |
| 4,075,581 | A | 2/1978 | Davidson et al. | |
| 4,821,007 | A | 4/1989 | Fields et al. | |
| 5,521,563 | A | 5/1996 | Mazzochette | |
| 5,689,217 | A | 11/1997 | Gu et al. | |
| 6,515,556 | B1 * | 2/2003 | Kato et al. | 333/116 |
| 6,731,244 | B2 | 5/2004 | Killen et al. | |
| 6,756,860 | B2 * | 6/2004 | Shin | 333/116 |
| 7,345,557 | B2 * | 3/2008 | Podell | 333/109 |

FOREIGN PATENT DOCUMENTS

| | | |
|---|---|---|
| JP | 07-176919 | 7/1995 |
| JP | 2651336 | 5/1997 |
| JP | 2007/043547 | 2/2007 |
| KR | 10-2002-0025311 | 4/2002 |
| KR | 10-2004-0022686 | 3/2004 |

* cited by examiner

*Primary Examiner* — Dean O Takaoka
(74) *Attorney, Agent, or Firm* — Snell & Wilmer LLP

(57) ABSTRACT

An integrated coupler may vertically integrate a hybrid coupler and a directional coupler. The hybrid coupler may include a first quarter-wave metallic strip dielectrically coupled to a second quarter-wave strip. The directional coupler may include the second quarter-wave metallic strip dielectrically coupled to a third metallic strip. The first quarter-wave metallic strip may receive a first input signal. The second quarter-wave metallic strip may receive a second input signal, and it may superimpose the first quarter-wave metallic strip along a vertical space, so as to combine power received from the first input signal and the second input signal to form an output signal. The third quarter-wave metallic strip may superimpose the second quarter-wave metallic strip along the vertical space, so as to sample the output signal of the second quarter-wave metallic strip.

10 Claims, 9 Drawing Sheets

INTEGRATED HYBRID-DIRECT COUPLERS

CLAIM OF PRIORITY UNDER 35 U.S.C. §119

This application claims the benefit and priority of U.S. provisional application Ser. No. 61/466,891, entitled "Integrated Coupler," filed on Mar. 23, 2011. The entire disclosure of the U.S. provisional application is assigned to the assignee hereof and is hereby expressly incorporated by reference herein.

BACKGROUND

1. Field

The present invention generally relates to the field of electronic couplers, and more particularly to integrated hybrid-direct couplers.

2. Description of the Related Art

Conventional wireless transmitters incorporate a separate hybrid coupler and a separate directional coupler. The hybrid coupler is used for combining the output of two power amplifiers. The directional coupler is used for sensing and sampling the combined output of the hybrid coupler. The directional coupler is typically connected to the hybrid coupler in series.

However, this serial architecture degrades performance due to increased transmission loss. Mainly, each of the directional coupler and the hybrid coupler adds transmission loss to the transmit signal path. The increased transmission loss has become a pressing issue in recent years because of the enhanced requirement in transmission efficiency. Moreover, this serial architecture is spatially inefficient because it requires extra printed circuit board area for fitting and routing two individual separate electronic components.

Thus, there is a need for an integrated hybrid-direct coupler with improved transmission efficiency and spatial efficiency.

SUMMARY

The present invention provides an integrated coupler. The integrated coupler may vertically integrate a hybrid coupler with a directional coupler. The hybrid coupler may include a first quarter-wave metallic strip dielectrically coupled to a second quarter-wave metallic strip. The directional coupler may include the second quarter-wave metallic strip dielectrically coupled to a third quarter-wave metallic strip. The first, second, and third quarter-wave metallic strips may be positioned parallel to one another, but without contacting one another. Hence, the first, second, and third quarter-wave metallic strips are spaced apart from one another.

The first quarter-wave metallic strip may receive a first input signal. The second quarter-wave metallic strip may receive a second input signal, and it may superimpose the first quarter-wave metallic strip along a vertical space, so as to combine the power received from the first input signal and the second input signal to form an output signal. The third quarter-wave metallic strip may superimpose the second quarter-wave metallic strip along the vertical space, so as to sample the output signal of the second quarter-wave metallic strip.

Because the directional coupler may sense a sample of the output signal of the hybrid coupler through direct dielectric coupling and without relying on a serial connection thereto, the directional coupler may perform the sensing and/or sampling function without incurring any transmission loss. Moreover, because the directional coupler and the hybrid coupler may be vertically integrated, the area of the printed circuit board, as well as the manufacturing cost thereof, may be substantially reduced.

BRIEF DESCRIPTION OF THE DRAWINGS

Other systems, methods, features, and advantages of the present invention will be or will become apparent to one of ordinary skill in the relevant art upon examination of the following figures and detailed description. It is intended that all such additional systems, methods, features, and advantages be included within this description, be within the scope of the present invention, and be protected by the accompanying claims. Component parts shown in the drawings are not necessarily to scale, and may be exaggerated to better illustrate the important features of the present invention. In the drawings, like reference numerals designate like parts throughout the different views, wherein:

DETAILED DESCRIPTION

Apparatus, systems and methods that implement the embodiment of the various features of the present invention will now be described with reference to the drawings. The drawings and the associated descriptions are provided to illustrate some embodiments of the present invention and not to limit the scope of the present invention. Throughout the drawings, reference numbers are re-used to indicate correspondence between reference elements. In addition, the first digit of each reference number indicates the figure in which the element first appears.

Figure 1:
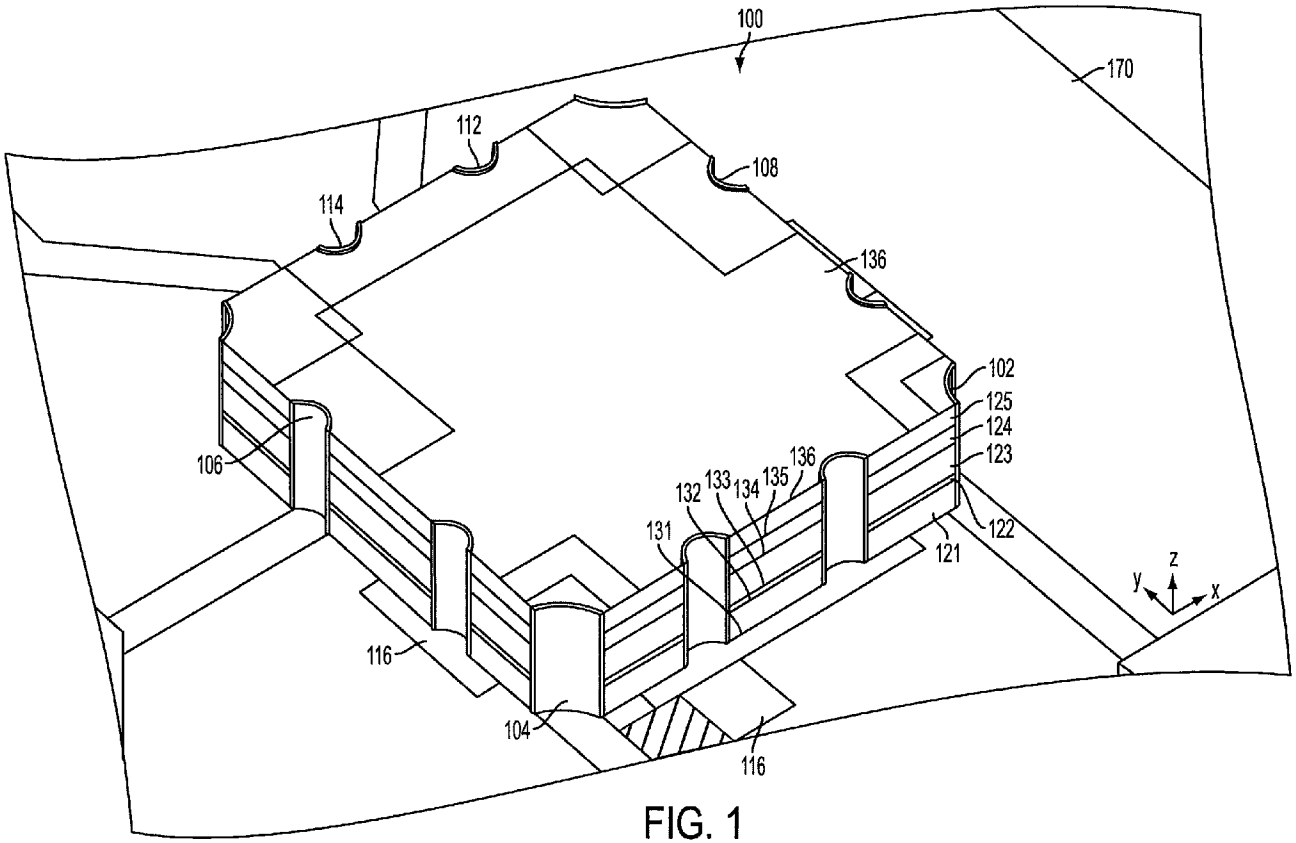
FIG. 1 shows a perspective view of an integrated coupler according to an embodiment of the present invention.

FIG. 1 shows a perspective view of an integrated (e.g., hybrid-direct) coupler 100 according to an embodiment of the present invention. The integrated coupler 100 may incorporate the functional features of a hybrid coupler and a directional coupler. Structurally, the integrated coupler 100 may adopt a parallel architecture, in which the integrated directional coupler may share a vertical space with the integrated hybrid coupler. The parallel architecture may be implemented with various coupler topologies. For example, the integrated hybrid coupler can have a branch-line structure, a broadside backward wave structure, and/or an edge-coupled structure. For another example, the integrated directional coupler can be placed as a broadside coupler or as an edge-coupled structure embedded within the integrated hybrid coupler.

Generally, the integrated coupler 100 may include several metallic layers and several dielectric layers, which may be formed between two successive metallic layers. In one embodiment, the integrated directional coupler may comprise a few top metallic layers and dielectric layers. In another embodiment, the integrated hybrid coupler may comprise a few bottom metallic layers and dielectric layers. In yet another embodiment, the integrated directional coupler and the integrated hybrid coupler may share a few middle metallic layers and dielectric layers.

Particularly, the integrated coupler 100 may include a first metallic layer 131, a second metallic layer 132, a third metallic layer 133, a fourth metallic layer 134, a fifth metallic layer 135, and a sixth metallic layer 136. Moreover, the integrated coupler 100 may include a first dielectric layer 121, a second dielectric layer 122, a third dielectric layer 123, a fourth dielectric layer 124, and a fifth dielectric layer 125. In one embodiment, for example, the first dielectric layer 121, the second metallic layer 132, the second dielectric layer 122, the third metallic layer 133, the third dielectric layer 123, and the fourth dielectric layer 124 may form the integrated hybrid layer. In another embodiment, the third metallic layer 133, the third dielectric layer 123, the fourth dielectric layer 124, and the fifth metallic layer 135 may form the integrated directional coupler.

The integrated coupler 100 may be bonded to a printed circuit board (PCB) 170, which may have a plurality of signal traces. The plurality of signal traces may provide input signals to and receive output signals from the integrated coupler 100. The integrated coupler 100 may include several via ports, such as a first input port 102, a second input port 104, a combined output port 106, a first isolation port 108, a directional coupled port 112, a second isolation port 114, and a plurality of ground ports 116. The first input port 102 may be used for receiving a first input signal and the second input port 104 may be used for receiving a second input signal. As shown as an exemplary embodiment, the first input port 102 and the second input port 104 are located at adjacent corners of the integrated coupler 100. The first input signal and the second input signal may have similar power level, which may range, for example, from about 100 Watts (W) to about 200 W. Moreover, the first input signal and the second input signal may be radio frequency (RF) signals, and they may have the same frequency. However, the second input signal may be about 90 degrees out of phase with the first input signal.

The first isolation port 108 and the second isolation port 114 may provide impedance matching to minimize reflection losses. For example, each of the first isolation port 108 and the second isolation port 114 may be coupled to an impedance element of about 50 ohms. The ground ports 116 may provide one or more ground source connections to the integrated coupler 100. The combined output port 106 may deliver a combined signal generated by the integrated hybrid coupler. In one embodiment, the power level of the combined signal is about 3 dB above one of the first input signal or the second input signal. The directional coupled port 112 may deliver or output a sensing signal from the integrated directional coupler. In one embodiment, the power level of the sensing signal is about 20 dB below one of the first input signal or the second input signal. When compared to a conventional directional coupler, the integrated directional coupler is much more efficient because the power loss incurred by the integrated directional coupler is significantly minimized.

Figure 2:
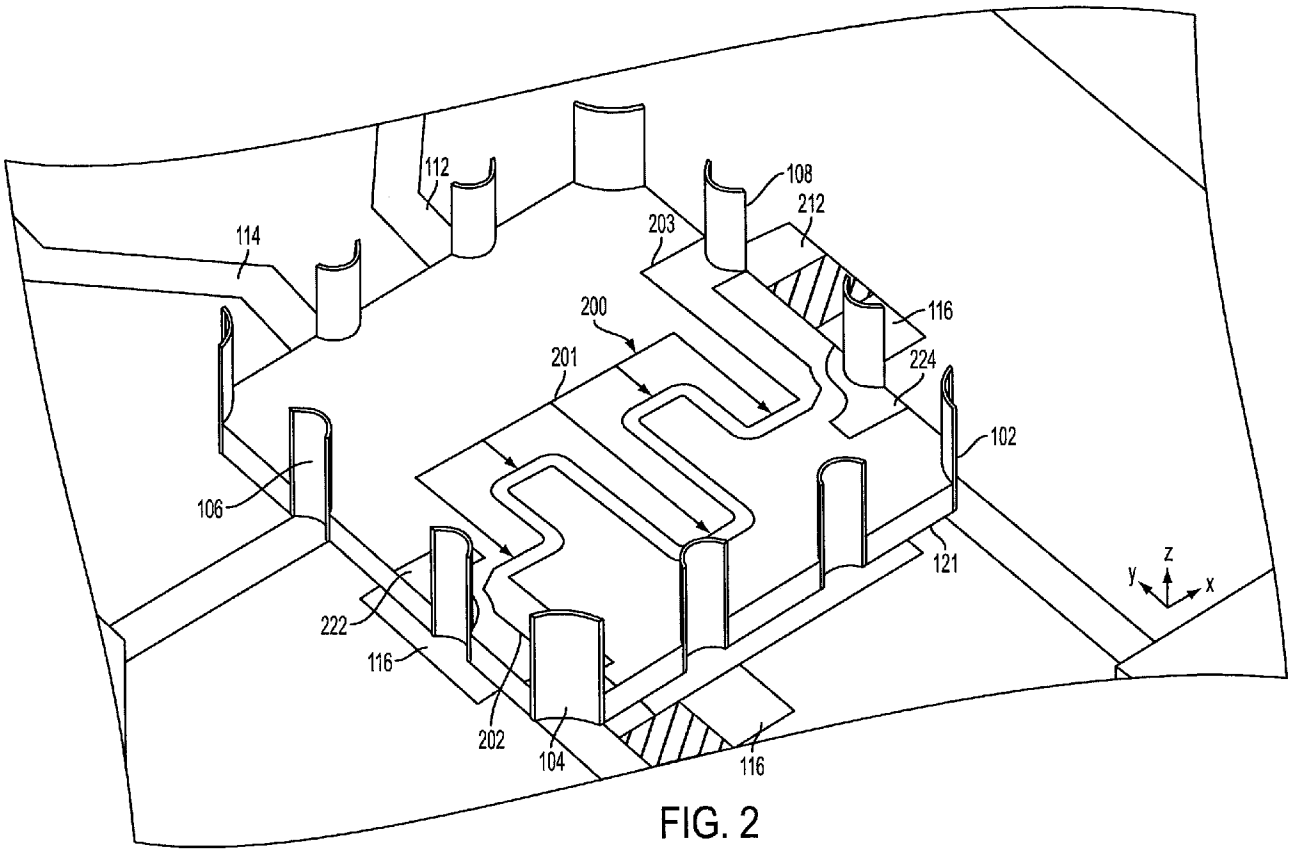
FIG. 2 shows a perspective view of a hybrid coupler strip according to an embodiment of the present invention.

FIG. 2 shows a perspective view of a hybrid coupler strip 200 according to an embodiment of the present invention. The hybrid coupler strip 200 may be a part of the second metallic layer 132, and it may be formed or printed on the first dielectric layer 121. The hybrid coupler strip 200 may be a component of the integrated hybrid coupler, and it may include a first input segment 202, a first quarter-wave segment 201, and a first isolation segment 203. The first input segment 202 is connected to the second input port 104 and may be used for receiving the second input signal from the second input port 104. The first input segment 202 may be dielectrically coupled to a ground strip 222, which may be connected to the ground port 116. The first input segment 202 is spaced apart from the ground strip 222.

The first quarter-wave segment 201 may be connected to the first input segment 202, and it may have a length of about one fourth of the wavelength of the second input signal. The first quarter-wave segment 201 may have a zigzag shape, and it may be positioned between the second input port 104 and the first isolation port 108. The first quarter-wave segment 201 lies along a first horizontal plane. The first isolation segment 203 may be connected to the first quarter-wave segment 201 and the first isolation port 108. The first isolation segment 203 may be dielectrically coupled to a ground strip 224, which may be connected to the ground port 116. The first isolation segment 203 is spaced apart from the ground strip 224. Because the first isolation port 108 is connected to a floating load 212, it may perform as a termination point for terminating the second input signal. To minimize reflection losses, the impedance of the floating load 212 may match the impedance of the second input port 104.

Figure 3:
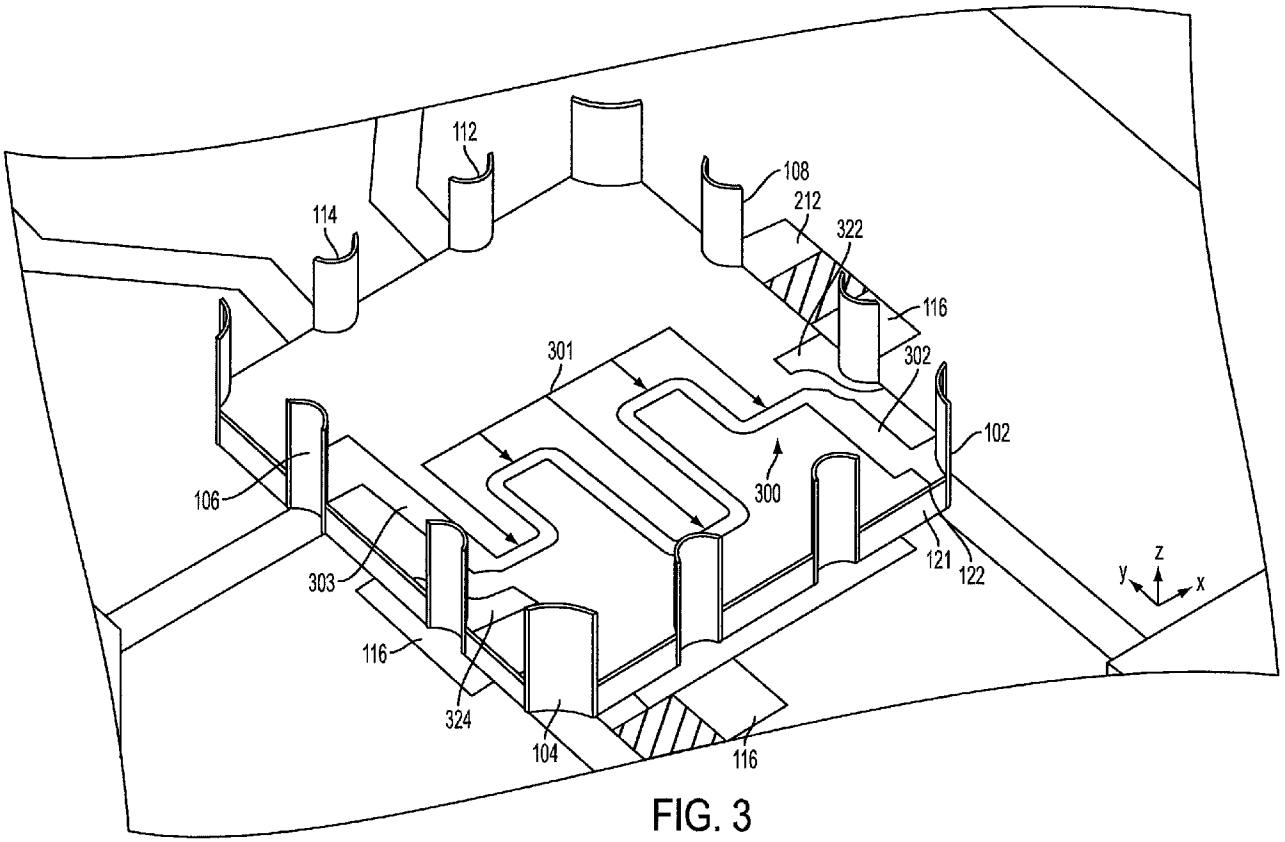
FIG. 3 shows a perspective view of a hybrid-directional coupler strip according to an embodiment of the present invention.

FIG. 3 shows a perspective view of a hybrid-directional coupler strip 300 according to an embodiment of the present invention. The hybrid-directional coupler strip 300 may be a part of the third metallic layer 133, and it may be formed or printed on the second dielectric layer 122. The hybrid-directional coupler strip 300 may be a component of the integrated hybrid coupler as well as the integrated directional coupler. Together, the hybrid-directional coupler strip 300 and the hybrid coupler strip 200 may form the integrated hybrid coupler. The hybrid-directional coupler strip 300 may include a second input segment 302, a second quarter-wave segment 301, and a combined output segment 303. The second input segment 302 may be used for receiving the first input signal from the first input port 102. The second input segment 302 may be dielectrically coupled to a ground strip 322, which may be connected to the ground port 116. The second input segment 302 is spaced apart from the ground strip 322.

The second quarter-wave segment 301 may be connected to the second input segment 302, and it may have a length of about one fourth of the wavelength of the first input signal. The second quarter-wave segment 301 lies along a second horizontal plane, which is substantially parallel to the first horizontal plane. The second quarter-wave segment 301 may have a zigzag shape, and it may be positioned between the first input port 102 and the combined output port 106. Moreover, the second quarter-wave segment 301 may be superimposing with the first quarter-wave segment 201, which is positioned below the second dielectric layer 122. As such, the second quarter-wave segment 301 may be able to absorb or receive the power of the second input signal from the first quarter-wave segment 201.

The combined output segment 303 may be connected to the second quarter-wave segment 301 and the combined output port 106. The combined output segment 303 may be dielectrically coupled to a ground strip 324, which may be connected to the ground port 116. The combined output segment 303 is spaced apart from the ground strip 324. The combined output segment 303 may deliver the output signal to the combined output port 106. The output signal may have a power level that is about 3 dB above the power level of one of the first input signal or the second input signal, and it may be in phase with the second input signal. Since the output signal combines most of the power from the first and second input signals, the integrated hybrid coupler may have high transmission efficiency.

Figure 4:
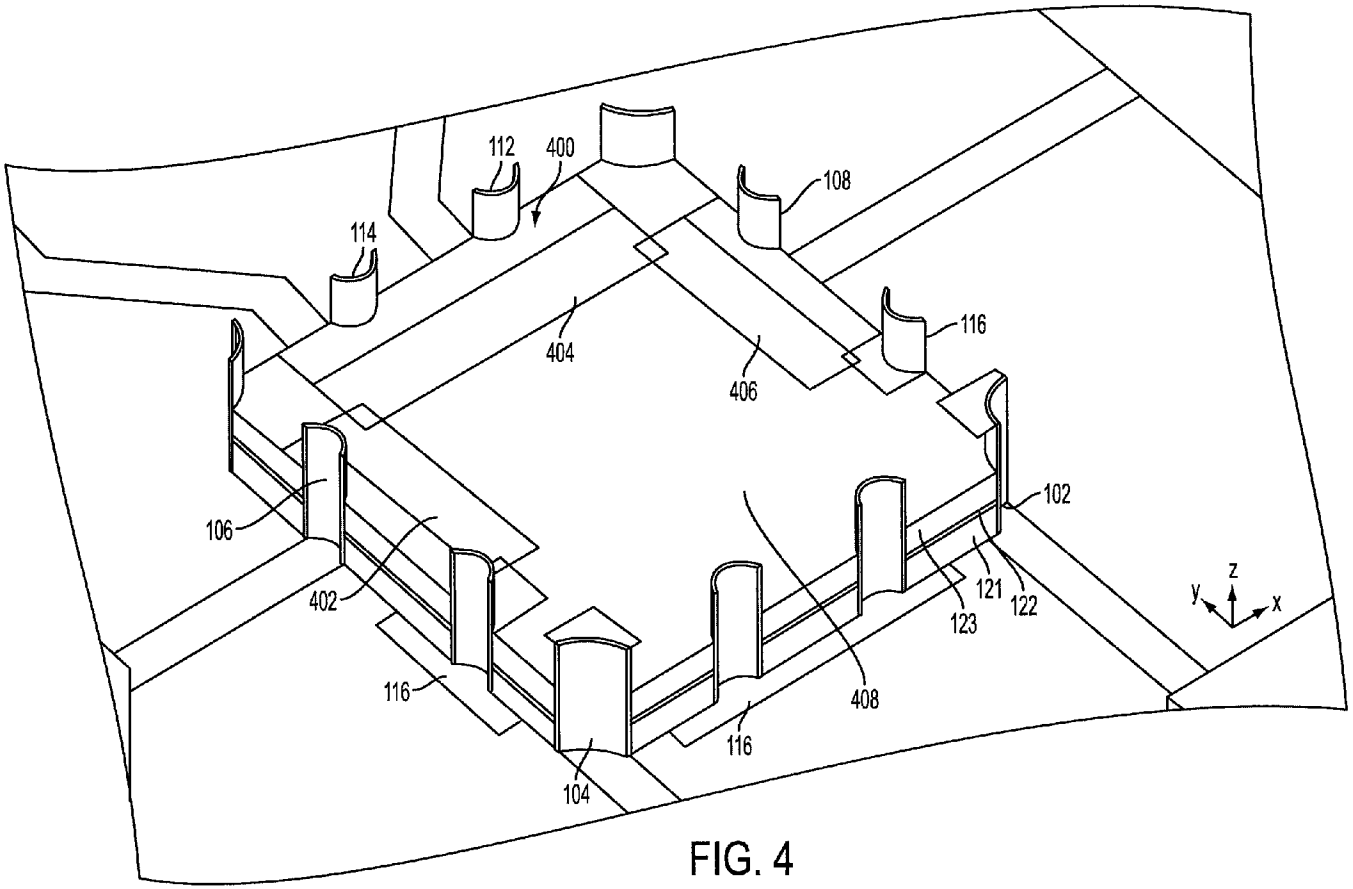
FIG. 4 shows a perspective view of a middle ground plane according to an embodiment of the present invention.

FIG. 4 shows a perspective view of a middle ground plane 400 according to an embodiment of the present invention. The middle ground plane 400 may be a part of the fourth metallic layer 134, and it may be formed or printed on the third dielectric layer 123. The middle ground plane 400 may serve as a tuning device and/or a shielding device for the integrated hybrid coupler and the integrated directional coupler. In one embodiment, the middle ground plane 400 extends across or is positioned over at least a portion of the third dielectric layer 123 for tuning, shielding and/or isolation purposes.

The middle ground plane 400 may include a first segment 402, a second segment 404, a third segment 406, and at least one aperture 408. The first segment 402 may be connected to the second segment 404, which may be connected to the third segment 406. The first segment 402, the second segment 404, and the third segment 406 may be arranged to define the aperture 408. In one embodiment, the aperture 408 may allow a partial coupling between the third metallic layer 133 and the fifth metallic layer 135. In another embodiment, the aperture 408 may have a shape and a length approximately the same as the second quarter-wave segment 301. In yet another embodiment, the aperture 408 may have a width that is smaller than the width of the second quarter-wave segment 301. In still yet another embodiment, the aperture 408 may be superimposed with the second quarter-wave segment 301.

The first segment 402 may be used for tuning the combined output segment 303 of the hybrid-directional coupler strip 300. The second segment 404 may be used for tuning the integrated directional coupler. The third segment 406 may be used for tuning the isolation segment 203 of the hybrid coupler strip 200. The first segment 402 and the third segment 406 may allow the integrated hybrid coupler to have a strip line structure. Together, the first segment 402, the second segment 404, and the third segment 406 may provide a shield between the I/O components of the integrated hybrid coupler and the I/O components of the integrated directional coupler. The first segment 402, the second segment 404, and the third segment 406 are each formed in the shape of a rectangular sheet.

Figure 5:
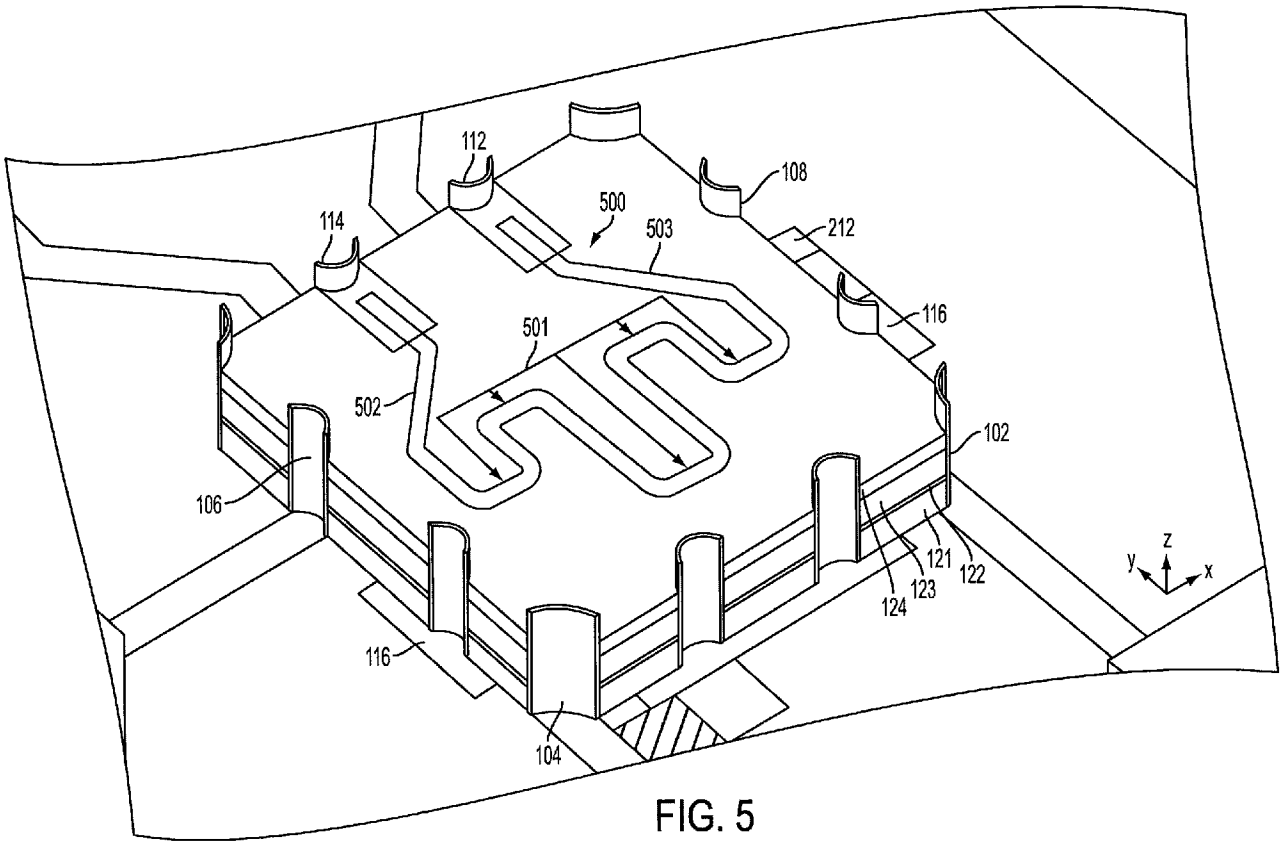
FIG. 5 shows a perspective view of a directional coupler strip according to an embodiment of the present invention.

FIG. 5 shows a perspective view of a directional coupler strip 500 according to an embodiment of the present invention. The directional coupler strip 500 may be a part of the fifth metallic layer 135, and it may be formed or printed on the fourth dielectric layer 124. The directional coupler strip 500 may be a component of the integrated directional coupler. Together, the directional coupler strip 500 and the hybrid-directional coupler strip 300 may form the integrated directional coupler. The directional coupler strip 500 may include a second isolation segment 502, a third quarter-wave segment 501, and a directional coupled segment 503. The second isolation segment 502 may be connected to the second isolation port 114. Accordingly, the second isolation segment 502 may be used for setting the direction of the directional signal.

The third quarter-wave segment 501 may be connected to the second isolation segment 502 and the directional coupled segment 503. As such, the third quarter-wave segment 501 may be positioned between the directional coupled port 112 and the second isolation port 114, and it may have a zigzag shape. Moreover, the third quarter-wave segment 501 may be superimposing with the second quarter-wave segment 301, which is positioned below the fourth dielectric layer 124 and the third dielectric layer 123. As such, the third quarter-wave segment 501 may be able to sense and/or sample a portion of the power of the combined output signal. To achieve optimal sensing efficiency, the third quarter-wave segment 501 may have a length of about one fourth of the wavelength of the combined output signal.

The directional coupled segment 503 may be connected to the third quarter-wave segment 501 and the directional coupled port 112. The directional coupled segment 503 may conduct or propagate the directional signal from the third quarter-wave segment 501 to the directional coupled port 112. The directional signal may have a power level that is about 20 dB below the power level of one of the first input signal or the second input signal. Accordingly, the loss incurred by the integrated directional coupler may be negligible because it does not include any transmission loss.

In one embodiment, the directional coupled segment 503 and the second isolation segment 502 may superimpose with the first segment 402, the second segment 404, and the third segment 406 of the ground plane 400. Consequently, the directional coupled segment 503 and the second isolation segment 502 may be shielded from the integrated hybrid coupler. In another embodiment, the third quarter-wave segment 501 may superimpose with the aperture 408 of the ground plane 400. As such, the third quarter-wave segment 501 may be dielectrically coupled to the second quarter-wave segment 301 of the hybrid-directional coupled strip 300 via the third dielectric layer 123 and the fourth dielectric layer 124.

Figure 6:
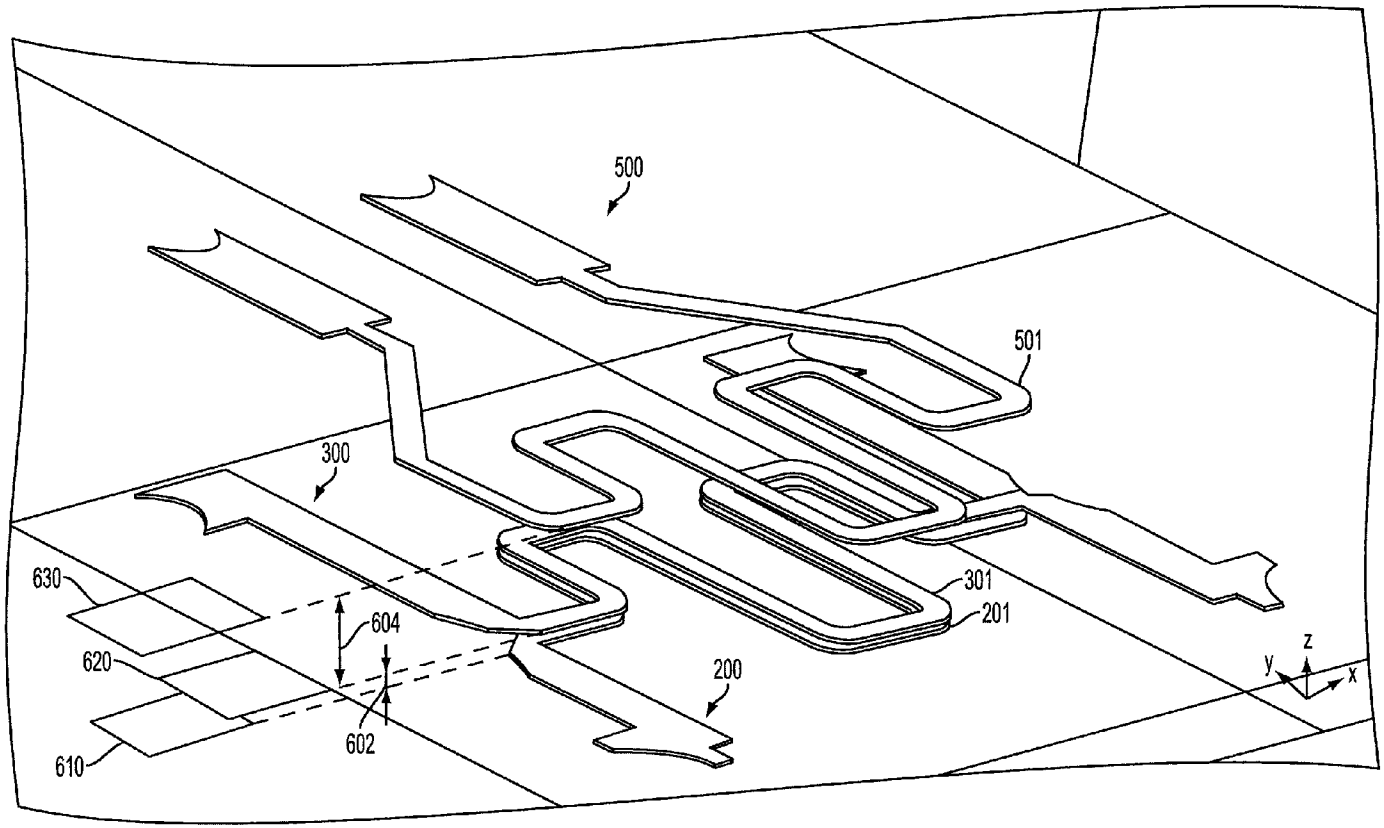
FIG. 6 shows the spatial relationship among the hybrid coupler strip, the hybrid-directional coupler strip, and the directional coupler strip according to an embodiment of the present invention.
Figure 7:
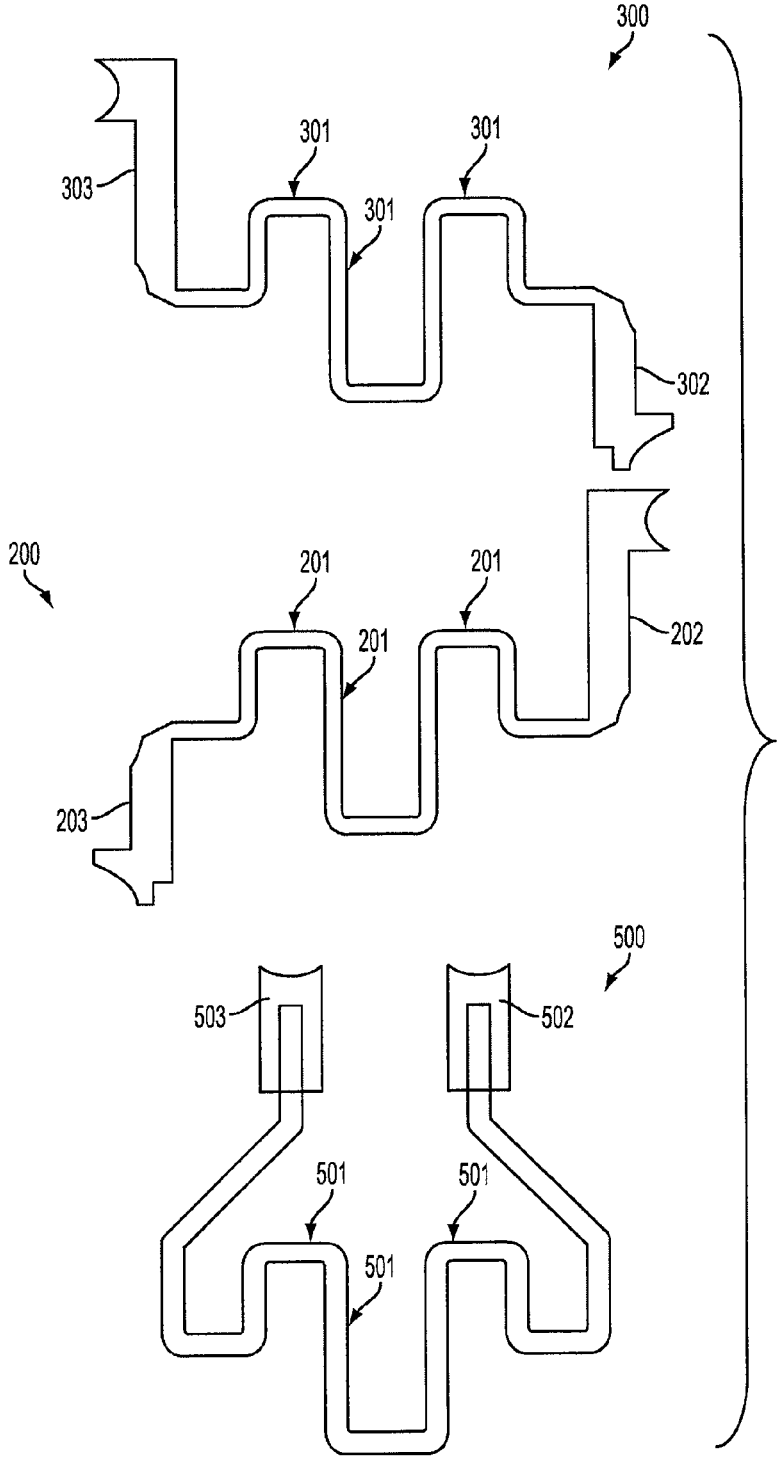
FIG. 7 shows the top views of the hybrid coupler strip, the hybrid-directional coupler strip, and the directional coupler strip according to an embodiment of the present invention.

FIGS. 6 and 7 show the spatial relationship among the hybrid coupler strip 200, the hybrid-directional coupler strip 300, and the directional coupler strip 500 as well as their respective top views according to an embodiment of the present invention. The first quarter-wave segment 201, the second quarter-wave segment 301, and the third quarter-wave segment 501 may be arranged along a vertical space. For example, one on top of the other but spaced apart from one another. Particularly, the first quarter-wave segment 201 may be positioned along a first plane 610, the second quarter-wave segment 301 may be positioned along a second plane 620, and the third quarter-wave segment 501 may be positioned along a third plane 630. The first plane 610, the second plane 620, and the third plane 630 may be substantially parallel to one another such that they will not intersect. The vertical space along which the first, second, and third quarter-wave segments 201, 301, and 501 are aligned may be substantially perpendicular to the first, second, and third planes 610, 620, and 630.

The first plane 610 may maintain a first distance 602 with the second plane 620. The second plane 620 may maintain a second distance 604 with the third plane 630. In one embodiment, the second distance 604 may be substantially greater than the first distance 602.

In another embodiment, for example, the second distance 604 may be about three times the first distance 602. The magnitude of power transfer within the integrated hybrid coupler may be inversely proportional to the square of the first distance 602. The magnitude of power transfer within the integrated directional coupler may be inversely proportional to the square of the second distance 604.

Therefore, the magnitude of power transfer within the integrated hybrid coupler is much larger than the magnitude of power transfer within the integrated directional coupler. As a result, the combined output signal may reserve the most power received from the first input signal and the second input signal, while the directional signal may sense and/or sample the combined output signal without significantly degrading the combined output signal. Moreover, because the integrated directional coupler may be stacked against the integrated hybrid coupler, the integrated coupler 100 may achieve optimal spatial efficiency by incorporating two devices in a single area or as a single chip, component, or device. Advantageously, the overall size of the PCB 170 may be substantially reduced. Furthermore, because the integrated hybrid coupler and the integrated directional coupler can be manufactured together as a single device, the cost of manufacturing may be driven down substantially.

Figure 8:
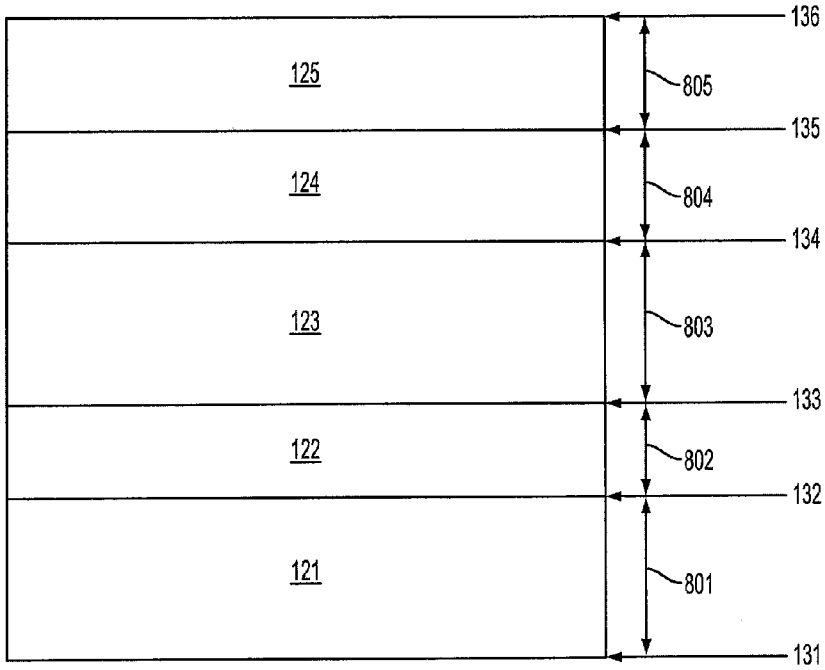
FIG. 8 shows various dimensions of the integrated coupler according to an embodiment of the present invention.

FIG. 8 shows various dimensions of the integrated coupler according to an embodiment of the present invention. Each of the first, second, third, fourth, and fifth dielectric layers 121, 122, 123, 124, and 125 may be made of a plastic material, a proxy material, a ceramic material, and/or a PTFE material. The first dielectric layer 121 may have a first thickness 801, which may range, for example, from about 10 mils to about 150 mils. The second dielectric layer 122 may have a second thickness 802, which may range, for example, from about 3 mils to about 20 mils. The third dielectric layer 123 may have a third thickness 803, which may range, for example, from about 10 mils to about 50 mils. The fourth dielectric layer 124 may have a fourth thickness 804, which may range, for example, from about 10 mils to about 50 mils. The fifth dielectric layer 125 may have a fifth thickness 805, which may range, for example, from about 10 mils to about 50 mils.

Each of the first, second, third, fourth, fifth, and sixth metallic layers 131, 132, 133, 134, 135, and 136 may be made of gold and/or copper. The first, fourth, and sixth metallic layers 131, 134, and 136 may be coupled to one or more ground sources. The second metallic layer 132 may be coupled between the second input port 104 and the first isolated port 108. The third metallic layer 133 may be coupled between the first input port 102 and the combined output port 106. The fifth metallic layer 135 may be coupled between the second isolated portion 114 and the directional coupled port 112.

Figure 9:
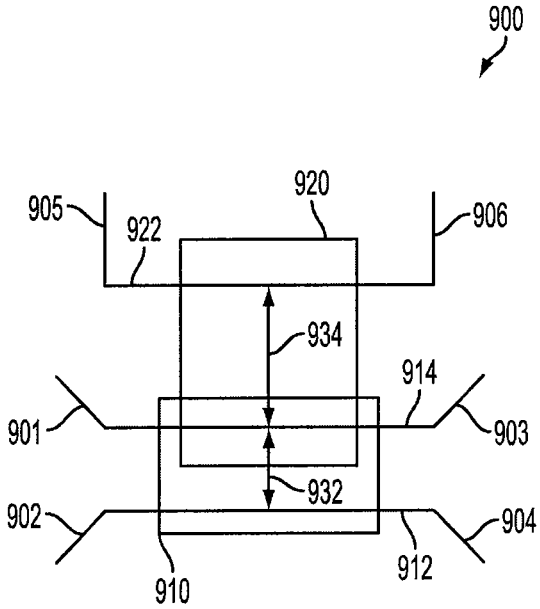
FIG. 9 shows a schematic view of the integrated coupler according to an embodiment of the present invention.

FIG. 9 shows a schematic view of the integrated coupler 900 according to an embodiment of the present invention. The integrated coupler 900 may include a first input port 901, a second input port 902, a combined output port 903, a first isolation port 904, a directional coupled port 905, and a second isolation port 906. The integrated coupler 900 may include at least three quarter-wave segments formed in three separated metallic layers. For example, the integrated coupler 900 may include a first quarter-wave segment 912, a second quarter-wave segment 914, and a third quarter-wave segment 922. The first quarter-wave segment 912 may be formed in a first metallic layer, and it may connect the second input port 902 and the first isolation port 904. The second quarter-wave segment 914 may be formed in a second metallic layer, and it may connect the first input port 901 and the combined output port 903. The third quarter-wave segment 922 may be formed in a third metallic layer, and it may connect the directional coupled port 905 and the second isolation port 906.

The first quarter-wave segment 912 may be dielectrically coupled to the second quarter-wave segment 922 to form a hybrid coupler 910. The hybrid coupler 910 may combine the power of the signals that are received from the first and second input ports 901 and 902, and in return, the hybrid coupler 910 may deliver the combined output at the combined output port 903.

The second quarter-wave segment 914 may be dielectrically coupled to the third quarter-wave segment 922 to form a directional coupler 920. The directional coupler 920 may sample and/or sense the combined output signal generated by the hybrid coupler 910. As such, the directional coupler 920 may deliver the sensed or sampled portion of the combined output signal at the directional coupled port 905.

The first and second quarter-wave segments 912 and 914 may maintain a first distance 932. The second and third quarter-wave segments 914 and 922 may maintain a second distance 934. To achieve efficient couplings for the hybrid coupler 910 and the directional coupler 920, the second distance 934 and the first distance 932 may be kept at a predefined ratio. In one embodiment, for example, the predefined ratio may be about three or a range from about two to about four. Although FIG. 9 shows that the directional coupler 920 is positioned above the hybrid coupler 910, the hybrid coupler 910 may be positioned above the directional coupler 920 according to an alternative embodiment of the invention.

Exemplary embodiments of the invention have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. An integrated coupler, comprising:

a first quarter-wave metallic strip configured to receive a first input signal;

a second quarter-wave metallic strip configured to receive a second input signal, and superimposing the first quarter-wave metallic strip along a vertical space, so as to combine power received from the first input signal and the second input signal to form an output signal; and a third quarter-wave metallic strip superimposing the second quarter-wave metallic strip along the vertical space, so as to sample the output signal of the second quarter-wave metallic strip.

2. The integrated coupler of claim 1, wherein:

the first quarter-wave metallic strip is dielectrically coupled to the second quarter-wave metallic strip to form a hybrid coupler.

3. The integrated coupler of claim 1, wherein:

the second quarter-wave metallic strip is dielectrically coupled to the third quarter-wave metallic strip to form a directional coupler.

4. The integrated coupler of claim 1, wherein:

the first quarter-wave metallic strip is positioned along a first plane, the second quarter-wave metallic strip is positioned along a second plane, the third quarter-wave metallic strip is positioned along a third plane, and the first plane, the second plane, and the third plane are aligned in parallel along the vertical space.

5. The integrated coupler of claim 1, further comprising:

a dielectric layer formed between the first quarter-wave metallic strip and the second quarter-wave metallic strip.

6. The integrated coupler of claim 1, further comprising:

a dielectric layer formed between the second quarter-wave metallic strip and the third quarter-wave metallic strip.

7. The integrated coupler of claim 1, further comprising:

a first dielectric layer having a first thickness, and formed between the first quarter-wave metallic strip and the second quarter-wave metallic strip; and a second dielectric layer having a second thickness, and formed between the second quarter-wave metallic strip and the third quarter-wave metallic strip, the second thickness being about three times the first thickness.

8. An integrated hybrid-directional coupler, comprising:

a first dielectric layer having a first thickness;

a first quarter-wave segment configured to receive a first input signal, formed on the first dielectric layer and positioned along a first horizontal plane;

a second dielectric layer having a second thickness and formed on the first dielectric layer, the first thickness being about two to four times the second thickness;

a second quarter-wave segment configured to receive a second input signal, formed on the second dielectric layer and positioned along a second horizontal plane that is substantially parallel to the first horizontal plane, the second quarter-wave segment coupled to the first quarter-wave segment to combine power received from the first input signal and the second input signal to form an output signal;

a third dielectric layer having a third thickness and formed on the second dielectric layer; and a third quarter-wave segment formed on the third dielectric layer and positioned along a third horizontal plane that is substantially parallel to the second horizontal plane, the third quarter-wave segment coupled to the second quarter-wave segment to sample the output signal of the second quarter-wave segment.

9. The integrated hybrid-directional coupler of claim 8, wherein:

the first quarter-wave segment is dielectrically coupled to the second quarter-wave segment to form a hybrid coupler.

10. The integrated hybrid-directional coupler of claim 8, wherein:

the second quarter-wave segment is dielectrically coupled to the third quarter-wave segment to form a directional coupler.

* * * * *